US006306068B1

(12) United States Patent
Heatwole

(10) Patent No.: US 6,306,068 B1
(45) Date of Patent: Oct. 23, 2001

(54) EXERCISING AND/OR AMUSEMENT DEVICE

(75) Inventor: Richard Heatwole, Corydon, IN (US)

(73) Assignee: Elrey Enterprises Inc., Corydon, IN (US)

( * ) Notice: Subject to any disclaimer, the term of this patent is extended or adjusted under 35 U.S.C. 154(b) by 0 days.

(21) Appl. No.: 09/569,980

(22) Filed: May 12, 2000

(51) Int. Cl.[7] ..... A63B 23/04
(52) U.S. Cl. ..... 482/146; 482/75
(58) Field of Search ..... 482/146, 147, 482/148, 79, 80, 75, 123, 129, 51; D21/689, 688, 662

(56) References Cited

U.S. PATENT DOCUMENTS

| | | | | |
|---|---|---|---|---|
| 735,319 | * | 8/1903 | Urwick . | |
| 1,565,484 | * | 12/1925 | McWhirter . | |
| 4,285,516 | | 8/1981 | Heatwole | 272/146 |
| 4,530,498 | | 7/1985 | Heatwole | 272/146 |
| 4,700,947 | | 10/1987 | Heatwole | 272/146 |
| 5,320,593 | | 6/1994 | Heatwole | 482/146 |
| 5,391,134 | | 2/1995 | Heatwole | 482/146 |
| 5,795,277 | * | 8/1998 | Bruntmyer | 482/146 |

* cited by examiner

*Primary Examiner*—Stephen R. Crow
(74) *Attorney, Agent, or Firm*—Drinker Biddle & Reath LLP

(57) ABSTRACT

An exercising and/or amusement device supported by a ground surface and on which a person may stand. The device includes a walking beam having first and second platforms at opposite ends thereof for supporting the feet of a person, each platform having an upper surface adapted to support one of the person's feet. A ground engaging element is associated with each platform. Each ground engaging element has a bottom surface for engaging a ground surface, a hemispherical supporting surface, and a pin extending from the hemispherical supporting surface. Each platform is pivotably connected to an associated ground engaging element by a pivotable connection including a curved concave bottom surface on each platform shaped complementary to the hemispherical supporting surface of the associated ground engaging element and having a slot therein through which the pin of the associated ground engaging element extends. A plurality of resilient members engages the pin and urges it toward a neutral position. The resilient members are oriented such that extension of at least one of the resilient members applies a restoring force to the pin along a longitudinal axis of the walking beam.

16 Claims, 5 Drawing Sheets

EXERCISING AND/OR AMUSEMENT DEVICE

FIELD OF THE INVENTION

The invention pertains to an exercise or amusement device on which a user may stand and which the user may cause to move, by movement of the user's feet or by shifting the user's body weight, for exercise or for amusement.

BACKGROUND OF THE INVENTION

The present invention is directed to improvements over my earlier U.S. Pat. Nos. 4,285,516, 4,530,498, 4,700,947, 5,320,593, and 5,391,134, each entitled "AMUSEMENT AND/OR EXERCISING DEVICE." The present invention is an exercise or amusement device having an improved centering mechanism which improves upon the devices disclosed in my earlier patents, making it easier for a user to learn to use the device and making it safer for all users.

SUMMARY OF THE INVENTION

In its broad aspect, the invention is an exercising and/or amusement device supported by a ground surface and on which a person may stand. The device comprises a walking beam having first and second platforms at opposite ends thereof for supporting the feet of a person, each platform having an upper surface adapted to support one of the person's feet. A ground engaging element is associated with each platform. Each ground engaging element has a bottom surface for engaging a ground surface, a hemispherical supporting surface, and a pin extending from the hemispherical supporting surface. Each platform is pivotably connected to an associated ground engaging element by a pivotable connection comprising a curved concave bottom surface on each platform shaped complementary to the hemispherical supporting surface of the associated ground engaging element and having a slot therein through which the pin of the associated ground engaging element extends. A plurality of resilient members engages the pin and urges it toward a neutral position. The resilient members are oriented such that extension of at least one of the resilient members applies a restoring force to the pin along a longitudinal axis of the walking beam.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
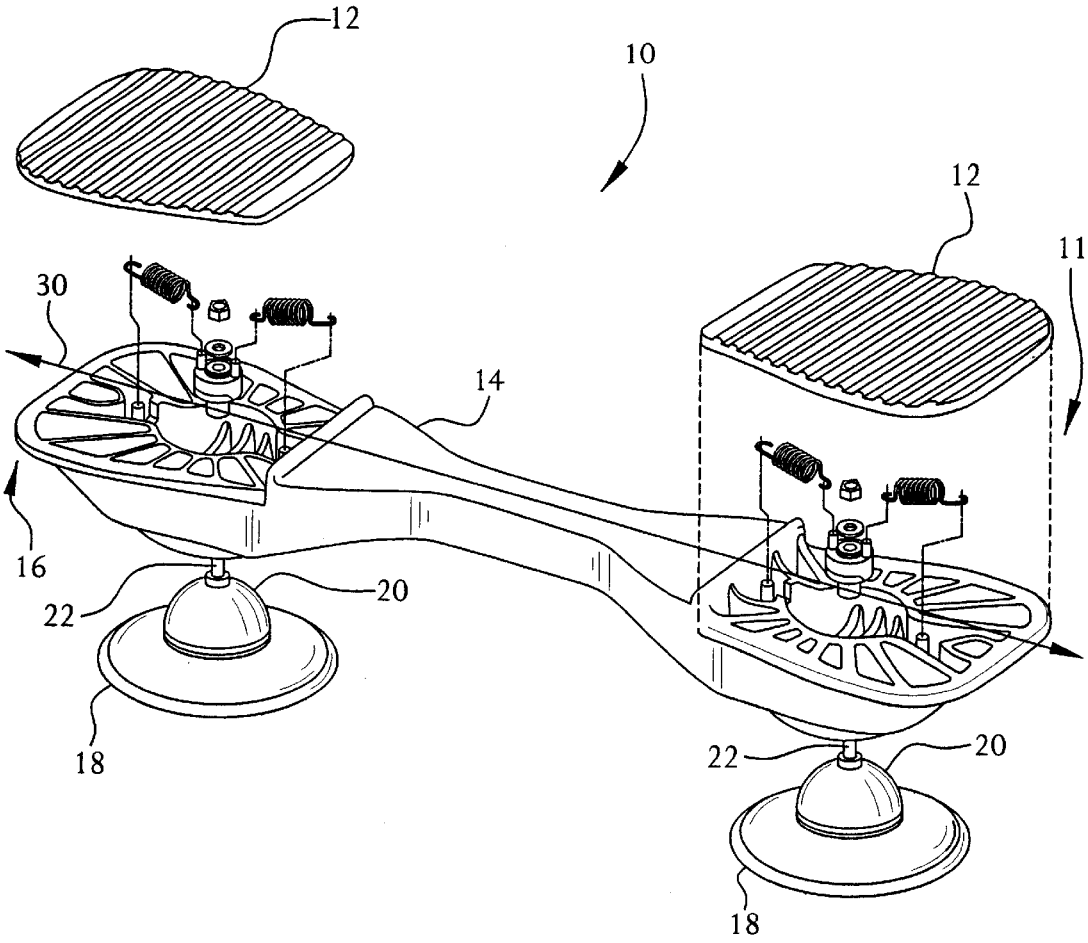
FIG. 1 is an exploded perspective view of an amusement device embodying the present invention.
Figure 2:
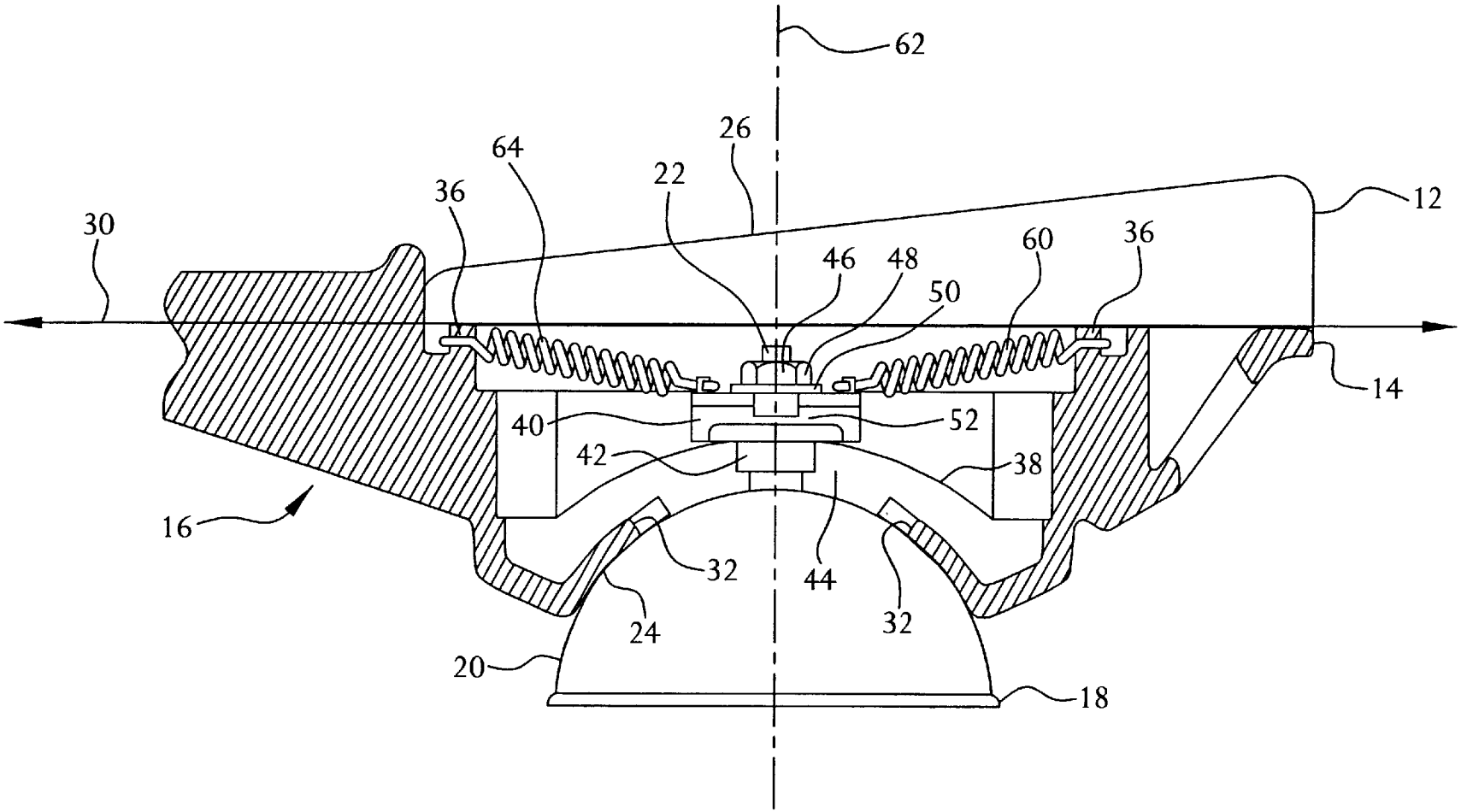
FIG. 2 is a cross-sectional view in side elevation of one end of an amusement device according to the present invention.

Referring now to the drawings, wherein like reference numerals illustrate corresponding or similar elements throughout the several views, FIG. 1 shows an exploded view of an exercise and/or amusement device 10 according to the present invention. Generally, it is intended that a user stand on the device, which is placed upon a supporting surface, or ground surface, such as a floor. Device 10 comprises a pair of platforms 11 for supporting a user's feet. Each platform 11 includes a foot contact surface 26, which is preferably, but not necessarily, in the form of a separate insert as shown. Contact surface 26 may be ridged as illustrated, or otherwise formed or treated to provide a desired degree of friction between contact surface 26 and the foot of a user to prevent slippage. Platforms 11 are rigidly interconnected by a crossbeam 14 and are preferably, although not necessarily, formed as an integral unit, as illustrated in the figures. The combination of platforms 11 and crossbeam 14 forms a walking beam 16. Ground engaging elements 18 are mounted below walking beam 16 and support beam 16. The top 20 of each ground engaging element is substantially hemispherical in shape. A cylindrical pin 22 extends from the top of each ground engaging element 18 and cooperates with a pivotable connection, described in greater detail below, for each platform 11. Preferably, the free end of pin 22 is threaded to receive a nut, as will be described below FIG. 2 is a cross-sectional view of one end of an amusement device embodying the present invention, showing details of the pivotable connection between the ground engaging element 18 and the walking beam 16. The opposite ends of the walking beam 16 are substantially identical, as are the ground engaging elements, so only one end of the device need be shown and described.

Walking beam 16 includes a curved concave bearing surface 24, which is complementary to the hemispherical top 20 of the associated ground engaging element 18, formed on the bottom of the crossbeam 14 below the platform 11. As can be seen in both FIG. 2 and FIG. 3, a slot 28 is formed in this surface 24, with the long axis of the slot 28 parallel to a longitudinal axis 30 of the device 10. Pin 22, which extends upward from the ground engaging element 18, is received in slot 28. The ends 32 of the slot 28 provide limit stops to limit the relative motion between the ground engaging element 18 and the walking beam 16 in a direction along axis 30 by limiting the travel of the pin 22. The width of slot 28 is slightly greater than the diameter of pin 22.

Preferably, each platform is generally hollow and includes integrally formed stiffening ribs. The stiffening ribs form a pocket 34 within platform 11. Pocket 34 receives a bushing 40, described in more detail below. At opposite ends of pocket 34, lying along longitudinal axis 30, are two raised bosses 36, which receive resilient biasing members in the form of helical springs 60 and 64.

As shown in FIG. 2, a bushing 40 is placed over the body of pin 22 that extends from the ground engaging element 18. The body 42 of the bushing 40 limits free play between the pin 22 and sides 44 of slot 28. The bushing 40 is retained on pin 22 by a retainer 46, such as a nut 48 threaded onto the free end of pin 22 and washer 50, as illustrated in the preferred embodiment. The bushing 40 is free to rotate about the pin 22, thus allowing the ground engaging means 18 to rotate relative to the crossbeam 14. Friction between the bushing 40 and the concave bearing surface 24 can be controlled to some degree by tightening or loosening nut 48, in order to make it more or less difficult to move the platforms 11 relative to the ground engaging members 18. A shoulder 52 on the bushing 40 abuts a retaining member 38 formed in platform 11, so as to prevent the pin 22 from being withdrawn from the platform 11, thus holding the concave bearing surface 24 in contact with the hemispherical top of ground engaging element 18.

Figure 3:
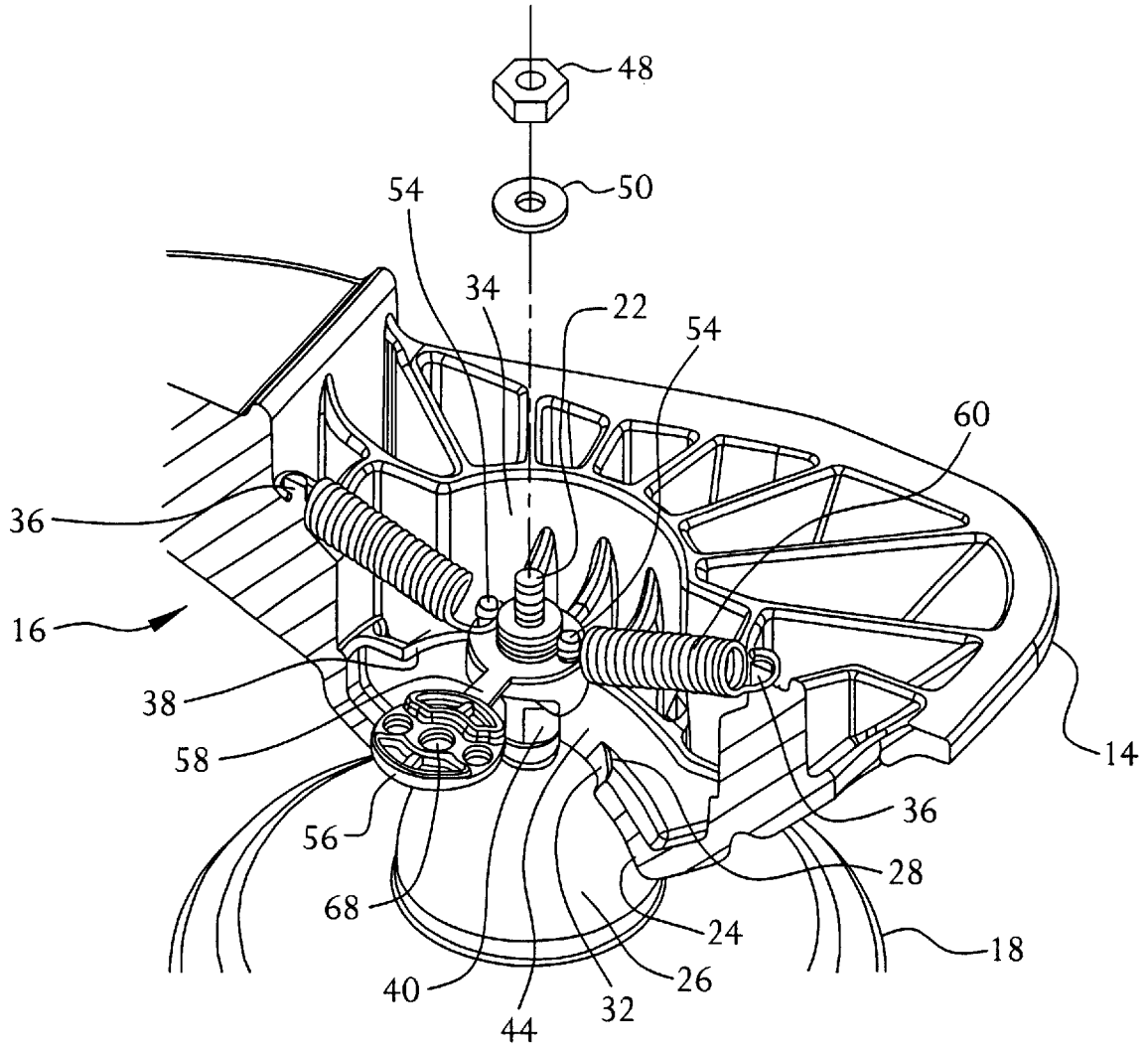
FIG. 3 is a cross-sectional view in perspective of one end of an amusement device according to the present invention.

As shown in FIG. 3, the top of the bushing 40 has two posts 54 extending from the shoulder 52. Two resilient members, such as helical springs 60 and 64, extend from the posts 54 to the raised bosses 36. The springs 60 and 64 are chosen such that extension of the springs 60 and 64 provides adequate restorative force to provide a desired centering action. When they are installed, both springs 60 and 64 are stretched a small amount to put them under an initial tension. Because the springs are on opposite sides of bushing 40, both springs apply a substantially equal biasing force on the bushing 40, which urges the pin 22 to a neutral position, indicated by dashed line 62 in FIG. 2, centered in slot 28. As the platform 11 moves relatively to ground engaging element 18, pin 22 moves in slot 28 relative to platform 11 and stretches one or the other of springs 60 and 64. The extension of the spring increase the restorative force applied to bushing 40, urging the platform back to the neutral position relative to ground engaging element 18.

As can be seen in FIG. 3, a cap 56 is connected to the bushing by a thin flexible strap 58. The cap 56 has an aperture 68 through the center through which pin 22 can pass. Once the springs 60 and 64 have been installed between raised bosses 36 and the posts 54, the cap 56 can be snapped in place around posts 54 to hold the springs 60 and 64 in place. After the cap has been snapped on, washer 50 is placed over the free end of pin 22, and nut 48 is threaded onto pin 22 to hold cap 56 and springs 60 and 64 in place.

Preferably, springs 60 and 64 remain under tension at all times, so that they always apply a restorative force to bushing 40. In addition, higher spring constants can be employed compared with previous devices of this type, thus increasing the tendency of the ground engaging elements 18 to return to the neutral position. This allows greater resistance to relative motion between the ground engaging elements 18 and their respective platforms 11, in turn improving the controllability of the device.

When both ground engaging elements 18 are in contact with a ground surface, the platforms 11 face upward. The user can then stand on the device by placing the user's feet on the platform. When the user of the device uses his foot to apply enough pressure to one of the platforms, that platform pivots relative to its associated ground engaging element, and the ground engaging element 18 at the opposite end of the device is raised out of contact with the ground surface. When that happens, the arrangement of the springs 60 and 64 at the opposite end urges the opposite ground engaging element to a neutral position. The user can then shift the user's body weight to pivot the platform 11 around its associated pin, so as to move the ground engaging element at the opposite end to a different location over the ground surface. Shifting his weight again enables the user to place the opposite ground engaging element in contact with the ground surface. Repeating these motions enables the user to "walk" the device from spot to spot on the ground surface.

The ease of using the device is enhanced by the increased range of motion permitted by the improved pivotable connection of the present invention. In the described embodiment, the slots 28 are fashioned such that the pins 22 of the ground engaging elements 18 can move approximately twenty degrees in each direction from their neutral position in the center of the slot.

Figure 4:
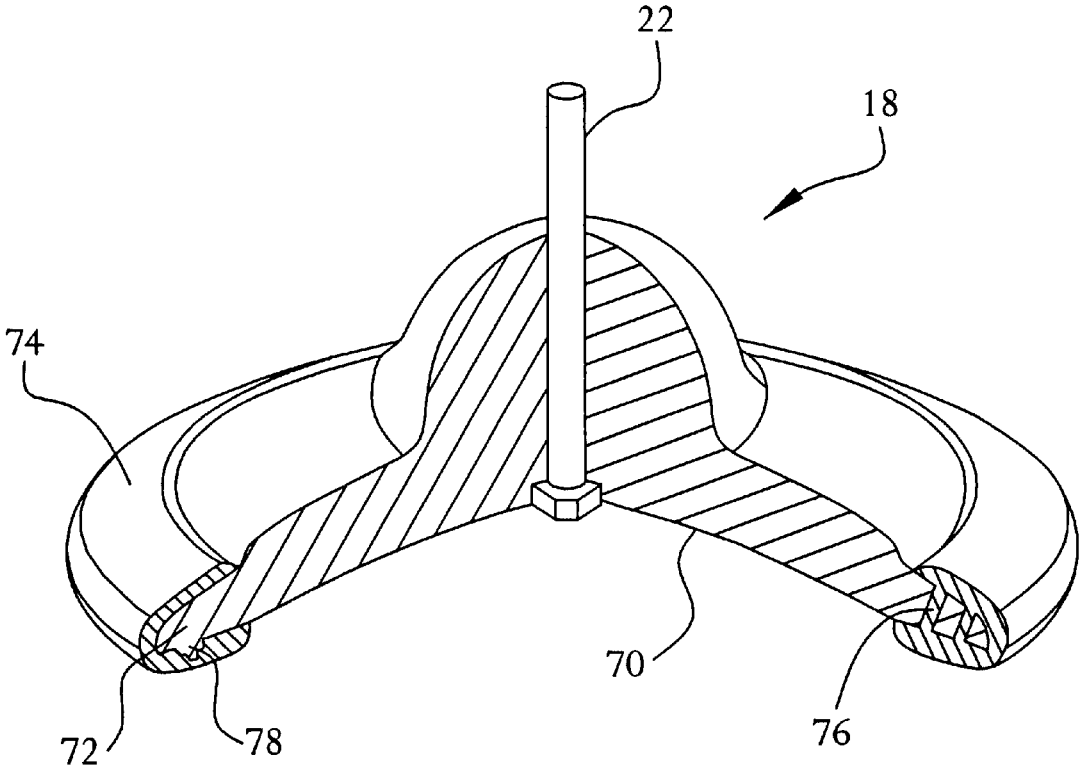
FIG. 4 is a perspective view, partially in section, of a ground engaging element according to the present invention.

The ground engaging elements are shown in greater detail in FIG. 4. The underside 70 of the ground engaging element 18 is generally concave, with a circumferential flange 72. An elastomeric covering 74 is formed around this flange 72 to increase the friction between the ground engaging element 18 and the ground surface.

Figure 5:
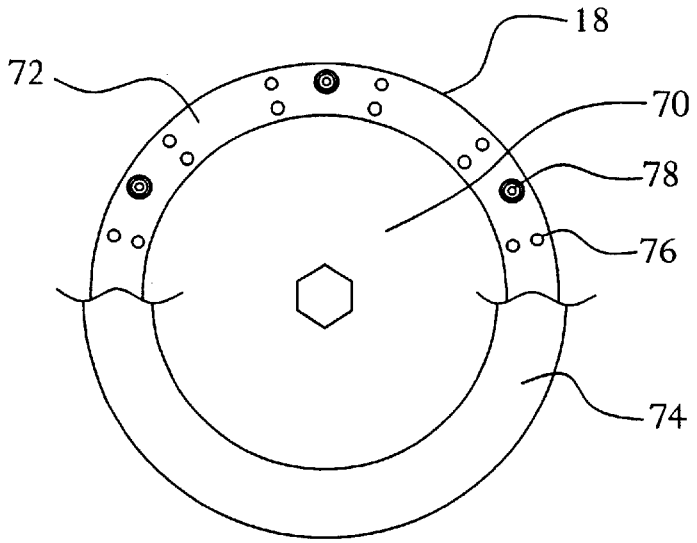
FIG. 5 is bottom plan view of a ground engaging element, partially broken away to illustrate internal structure of the ground engaging element.

The elastomeric covering 74 is preferably formed integrally with the ground engaging element 18 to prevent the elastomeric covering 74 from inadvertently separating from the ground engaging element. In the illustrated embodiment, passages 76 are formed through the ground engaging element 18. The elastomeric covering 74 is then molded, cast, or otherwise formed around the perimeter of flange 72, such that the elastomeric material of elastomeric covering 74 fills the passages 76 and forms a web of strands to connect the material on one side of flange 74 to the material on the other side of flange 74 through the passages in ground engaging element 18. As shown in FIG. 5, these passages 76 are spaced around the flange 72 of the ground engaging element 18, providing for multiple points where the elastomeric covering 74 is attached to the ground engaging element 18.

Figure 6:
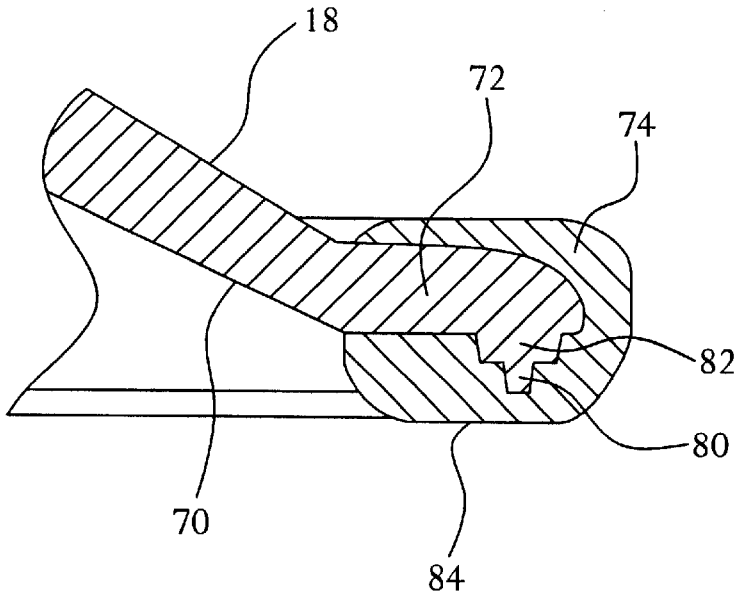
FIG. 6 is a partial cross sectional view of the edge of a ground engaging element, showing a wear indicator according to the present invention.

Flange 72 is also provided with wear indicators in the form of downwardly extending posts 78. As shown in FIG. 6, the posts 78 comprise a column having a thin lower portion 80 and a thicker upper portion 82. As the elastomeric covering 74 wears away with use of the device, the thin portion 80 will eventually show through the elastomeric covering 74 when the elastomeric covering wears away to a degree that it no longer covers the thin portion 80 of posts 78. This indicates that the elastomeric covering is nearing the end of its useful life. After further use, when the thick portion 82 of posts 78 becomes visible, that is an indication that the elastomeric covering 74 has worn to the point where it has reached the end of its useful life, and the device must be replaced.

From the foregoing description it will be apparent that the invention described herein provides some simple yet effective improvements to a walking beam exercise and/or amusement device. As will be apparent to those familiar with the art, the invention may be embodied in other specific forms without departing from the spirit or essential characteristics thereof. The embodiments disclosed are therefore to be considered in all respects as illustrative rather than restrictive, the scope of the invention being indicated by the appended claims.

What is claimed is:

1. An exercising and/or amusement device supported by a ground surface and on which a person may stand, comprising a walking beam having first and second platforms at opposite ends thereof for supporting the feet of a person, each platform having an upper surface adapted to support one of the person's feet;

a ground engaging element associated with each platform, the ground engaging elements each having a bottom surface for engaging a ground surface, a hemispherical supporting surface, and a pin extending from the hemispherical supporting surface; and a pivotable connection connecting each platform with an associated ground engaging element, comprising a curved concave bottom surface on each platform shaped complementary to the hemispherical supporting surface of the associated ground engaging element and having a slot therein through which the pin of the associated ground engaging element extends, a plurality of resilient members engaging the pin and urging the pin toward a neutral position, the resilient members being oriented such that extension of at least one of the resilient members applies a restoring force to the pin along a longitudinal axis of the walking beam.

2. An exercising and/or amusement device according to claim 1, each pivotable connection further comprising a bushing affixed to the pin intermediate the pin and the slot, the bushing having a shoulder having an outer diameter substantially equal to the width of the slot, the shoulder portion extending into the slot.

3. An exercising and/or amusement device according to claim 1, wherein each pivotable connection has a neutral position defined by the position of a pin relative to the walking beam when both ground engaging elements are in contact with a level surface, wherein the slot in each concave curved bottom surface allows travel of the associated pin to between 15 and 25 degrees in each direction from the neutral position.

4. An exercising and/or amusement device according to claim 1, wherein the resilient members comprise a first and a second helical spring, the helical springs being disposed along a line substantially parallel to the longitudinal axis of the walking beam and on opposite sides of the pin.

5. An exercise and/or amusement device according to claim 1, wherein the curved supporting surface is hemispherical.

6. An exercising and/or amusement device for resting upon a ground surface and supporting the feet of a person, comprising:

first and second platforms spaced from each other, each platform having a center and an upper surface, said upper surface adapted to receive one of the feet of a person;

a rigid crossbeam having first and second ends, the first and second platforms being connected to the crossbeam at the first and second ends, respectively, the crossbeam further having first and second concave curved bottom surfaces below the platforms, the crossbeam further having a longitudinal axis parallel to an imaginary line extending from the center of the first platform to the center of the second platform;

first and second pockets formed in each end of the crossbeam, the pockets being located between the platforms and the concave curved bottom surfaces;

a slot formed in each concave curved bottom surface and extending parallel to the longitudinal axis and having ends and side edges;

a ground engaging element operatively associated with each platform, the ground engaging elements each having a bottom surface, a curved top surface complementary to the concave curved bottom surfaces of the crossbeam, and a pin extending from the curved top surface;

a pivotable connection connecting each ground engaging element with an associated platform, the pivotable connection being formed at least in part by abutting contact of the concave curved bottom surfaces of the crossbeam with the curved upper surfaces of the associated ground engaging elements, the pin of the associated ground engaging element extending through the slot into the pockets, each pin being urged to a neutral position by a plurality of resilient members extending from the pin to the crossbeam, the resilient members oriented such that extension of at least one of the elastic element results in a force being applied to the pin along an axis parallel to the longitudinal axis of the crossbeam, said force urging the pin to a neutral position.

7. An exercising and/or amusement device according to claim 6, wherein the pivotable connection further comprises a bushing affixed to the pin intermediate the pin and the slot, the bushing having a shoulder portion having an outer diameter substantially equal to the width of the slot.

8. An exercising and/or amusement device according to claim 6, wherein the pivotable connection has a neutral position defined by the position of a pin relative to the crossbeam when both ground engaging elements are in contact with a level surface, the slot in each concave curved bottom surface allowing travel of the associated pin to between 15 and 25 degrees in each direction from the neutral position.

9. An exercising and/or amusement device according to claim 6, wherein the resilient members comprise a first and a second helical spring, the helical springs being disposed along a line substantially parallel to the longitudinal axis of the crossbeam, the first spring being located on one side of the pin and the second spring being located on the opposite side of the pin.

10. A ground engaging element for an amusement and/or exercising device, comprising a bottom surface having a circular flange therearound, a curved top surface, and an elastomeric covering around the flange, the flange having a plurality of passages therethrough through which the elastomeric covering extends to retain the elastomeric covering to the ground engaging element.

11. A ground engaging element according to claim 10, further comprising a wear indicator within the elastomeric covering for indicating to a user a worn condition of the elastomeric covering.

12. A ground engaging element according to claim 11, wherein the wear indicator means comprises at least one post depending from the bottom surface and being surrounded by the elastomeric covering, the post further having a length such that wear of the elastomeric covering causes the post to become visible at the exterior surface of the elastomeric covering.

13. A ground engaging element according to claim 12, wherein the post further comprises an upper and a lower portion each having a cross-sectional area, wherein the cross-sectional area of said upper portion is larger than the cross-sectional area of the lower portion to provide an indication of the amount of wear of the elastomeric covering.

14. A ground engaging element for an amusement and/or exercising device, comprising a bottom surface having a circular flange, a curved top surface, and an elastomeric covering surrounding the flange, the ground engaging element further including a wear indicator within the elastomeric covering for indicating to a user that the elastomeric covering has worn a preselected amount.

15. A ground engaging element according to claim 14, wherein the wear indicator means comprises at least one post depending from the bottom surface and being surrounded by the elastomeric covering, the post further having a length such that wear of the elastomeric covering causes the post to become visible at the exterior surface of the elastomeric covering.

16. A ground engaging element according to claim 15, wherein the post further comprises an upper and a lower portion each having a cross-sectional area, wherein the cross-sectional area of said upper portion is larger than the cross-sectional area of the lower portion to provide an indication of the amount of wear of the elastomeric covering.

* * * * *